US007265651B2

(12) United States Patent
Brunner

(10) Patent No.: US 7,265,651 B2
(45) Date of Patent: Sep. 4, 2007

(54) INDUCTIVE COMPONENT AND METHOD FOR THE PRODUCTION THEREOF

(75) Inventor: Markus Brunner, Bessenbach (DE)

(73) Assignee: Vacuumschmelze GmbH & Co. KG (DE)

( * ) Notice: Subject to any disclaimer, the term of this patent is extended or adjusted under 35 U.S.C. 154(b) by 64 days.

(21) Appl. No.: 10/276,653

(22) PCT Filed: Apr. 5, 2001

(86) PCT No.: PCT/EP01/03862

§ 371 (c)(1),
(2), (4) Date: Mar. 25, 2003

(87) PCT Pub. No.: WO01/91141

PCT Pub. Date: Nov. 29, 2001

(65) Prior Publication Data

US 2003/0156000 A1 Aug. 21, 2003

(30) Foreign Application Priority Data

May 19, 2000 (DE) ..... 100 24 824

(51) Int. Cl.
*H01F 27/24* (2006.01)

(52) U.S. Cl. ..... 336/233

(58) Field of Classification Search ..... 336/177, 336/221, 213, 65, 83, 90–96, 200, 233; 29/602.1
See application file for complete search history.

(56) References Cited

U.S. PATENT DOCUMENTS 4,305,056 A * 12/1981 Mochida et al. ..... 336/178
5,160,379 A * 11/1992 Yoshizawa et al. ..... 148/108
6,028,353 A * 2/2000 Nakano et al. ..... 257/701
6,373,368 B1 * 4/2002 Shikama et al. ..... 336/200
6,791,445 B2 * 9/2004 Shibata et al. ..... 336/90

FOREIGN PATENT DOCUMENTS

| | | |
|---|---|---|
| DE | 19846781 | 9/2002 |
| EP | 0112577 | 7/1984 |
| EP | 0 302 355 A * | 2/1989 |
| EP | 0302355 | 2/1989 |
| EP | 0271657 | 11/1989 |
| EP | 0455113 | 11/1991 |
| EP | 0794538 | 9/1997 |

OTHER PUBLICATIONS

Patent Abstracts of Japan, vol. 018, No. 063 (E-1500), Feb. 2, 1994, and JP 05 283238, Oct. 29, 1993.

(Continued)

*Primary Examiner*—Tuyen T. Nguyen
(74) *Attorney, Agent, or Firm*—Dean W. Russell; Kristin M. Crall; Kilpatrick Stockton LLP

(57) ABSTRACT

The invention relates to an inductive component (10) whose soft magnetic core (11) is produced by pouring a casting resin into a mold (1*a*) filled with a soft magnetic alloy powder and by subsequently hardening the casting resin with the alloy powder in order to form a solid soft magnetic core. Contrary to conventional injection molding methods, this technique prevents the surface insulation of the alloy particles from becoming damaged so that the formation of bulk eddy currents in the resulting soft magnetic cores can be prevented to a large extent. This enables a distinct reduction in the electric loss of the inductive component.

10 Claims, 1 Drawing Sheet

OTHER PUBLICATIONS

Figure 1:
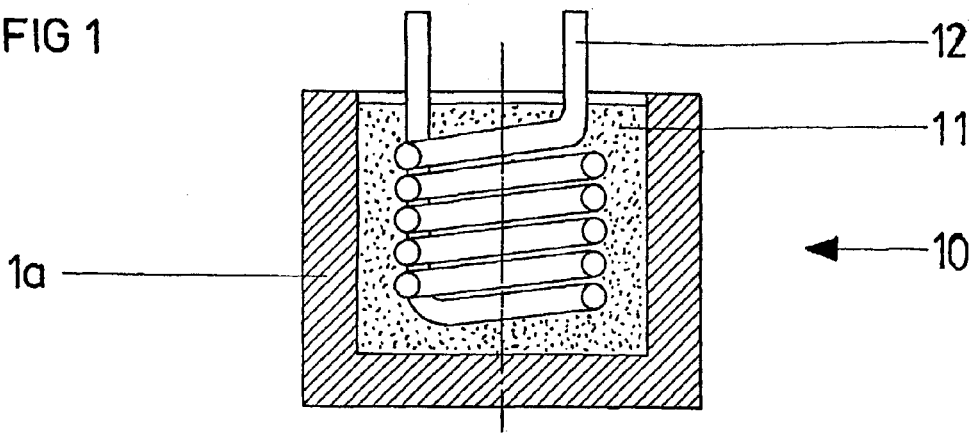

Patent Abstracts of Japan, vol. 010, No. 375 (M-545), Dec. 13, 1986, and JP 61 166902, Jul. 28, 1986.

Patent Abstracts of Japan, vol. 012, No. 094 (E-593), Mar. 26, 1988, and JP 62 226603, Oct. 5, 1987.

* cited by examiner

INDUCTIVE COMPONENT AND METHOD FOR THE PRODUCTION THEREOF

This application claims priority to German Application No. 100 24 824.1 filed on Apr. 5, 2001 and International Application No. PCT/EP01/03862 filed on May 19, 2000, the entire contents of which are incorporated herein by reference.

The invention relates to an inductive component having at least one coil and a soft magnetic core made from a ferromagnetic material. The invention is concerning the inductive components in particular, which have a soft magnetic core that consists of a powder composite.

Soft magnetic powder composites as pressed magnetic cores have been known for a long time.

Firstly, pressed powder composites made from iron powder are known. A permeability area of approx. 10 to 300 can be covered quite well using this magnetic core. The saturation flux density, which can be obtained using these magnetic cores, is at approx. 1.6 tesla. The application frequencies are generally below 50 kHz due to the comparatively low resistivity and the iron particles' size.

Furthermore, pressed powder composites made from soft magnetic crystalline iron aluminum silicon alloys are known as well. Application frequencies exceeding 100 kHz can be reached with these composites due to the comparatively higher resistivity.

Saturation flux densities and permabilities, which are particularly good, can be achieved using powder composite materials, which are based on crystalline mumetals. Permeabilities reaching up to 500 can be achieved via an exact allocation of the nickel content allowing for application frequencies exceeding 100 kHz due to the comparatively minor remagnetizing losses.

However, these three known powder composites can only be processed into very simple geometric forms, as the available press technologies only allow for a limited range. In particular, only toroids and/or pot cores can be produced.

To avoid this disadvantage, an injection molding method was presented in DE 198 46 781 A1, in which nanocrystalline alloys are incorporated into an injection molding capable plastic, and subsequently processed into soft magnetic cores by means of an injection molding method.

It became apparent, however, that the injection molding approaches, which initially seemed to be quite promising, had limitations. A major disadvantage consisted in the alloy particles of the alloy powder made from amorphous or nano-crystalline alloys being exposed to extreme mechanical loads particularly while being injected into the deployed tools. This generally lead to damages of the alloy particles' surface insulation. The alloy particles' damaged surface insulations in turn leads to increased remagnetizing losses due to bulky eddy currents in the produced soft magnetic cores.

An additional problem concerning the injection molding method consists in the constancy of the coils' insulation with respect to the soft magnetic core. The mold, which is equipped with coils during the production process, is acting rather abrasively due to the alloy particles, which are integrated therein, which leads to increased damages of the coils' insulation. Increased serious damage occurs in particular, when using coils consisting of copper wires that are insulated with lacquer, or copper strands that are insulated with lacquer.

Furthermore, the fact that they require very expensive injection molding molds, the production of which is very costly, is a disadvantage of the injection molding method.

The task of the invention at hand therefore consists in providing an inductive component having at least one coil and a soft magnetic core made from a ferro-magnetic powder composite, which can be produced in a simple manner, and whereby a damage of the insulations of the coils will be avoided as much as possible during the manufacturing process, and where the alloy powder will not be exposed to any or only to non-critical mechanical loads during processing.

Furthermore, the new inductive composite and the manufacturing method in connection thereto should not have to do without the advantages of the injection molding method. In particular, it should be possible to make inductive components, whose soft magnetic cores can have almost any shape, and whose volume utilization can be optimized.

According to this invention, these tasks are solved by means of an inductive component having at least one coil and one soft magnetic core made from a ferro-magnetic powder composite, which is characterized by a powder composite consisting of an alloy powder made from an amorphous or nano-crystalline alloy and a casting resin.

Nano-crystalline alloys are typically used for the alloy powders, as was described in detail, for instances, in EP 0 271 657 A2 or in EP 0 455 113 A2. Such alloys are typically manufactured by means of the fusion spin technology in form of thin alloy strips, which are amorphous initially, and which are subjected in a heat treatment in order to obtain the nano-crystalline structure. However, amorphous cobalt base alloys can also be used.

The alloys are milled into alloy powders having an average particle size of <2 mm. Gages ranging from 0.01 to 0.04 mm, and admeasurements of the two other dimensions ranging from 0.04 to 1.0 mm, are most advantageous.

The surfaces of the alloy particles are oxidized in order to achieve an electrical insulation of the alloy particles among themselves. This can be achieved on the one hand by oxidizing the ground alloy particles in an atmosphere, which contains oxygen. The surface oxidation can also be produced by means of the oxidation of an alloy strip before grinding it to an alloy powder.

The alloy particles could be coated with a plastic, for instance a silane or metal alkyl composite, for a continued improvement of the insulation of the alloy particles among each other, whereby the coating will be performed for 0.1 to 3 hours at a temperature ranging between 80° C. and 200° C. This method "burns" the coating "into" the alloy particles.

Polyamides or polyacrylates are typically used as casting resins, whereby the exact procedures will be discussed further below on the basis of the manufacturing method in accordance with this invention.

The inductive components, which were thus manufactured, can show saturation magnetizations $B_5 \geqq 0.5$ and permeabilities $\mu$ between 10 and 200.

The method in accordance with the invention for the production of an inductive component having at least one coil and one soft magnetic core made from a ferro-magnetic powder composite is characterized in its first embodiment of the invention by the following steps:

a) Providing a mold, an alloy powder and a casting resin formulation;

b) Filling the mold with an alloy powder;

c) Filling the casting resin formulation in the mold; and d) Curing the casting resin formulation.

In an alternative embodiment of the present invention the method for producing an inductive component having at least one coil and one soft magnetic core made from a ferro-magnetic powder composite is characterized by the following steps:

a) Providing a mold, an alloy powder and a casting iron formulation;

b) Mixing the alloy powder and the casting resin formulation into a casting resin powder formulation;

c) Filling the casting resin powder formulation into the mold; and d) Curing the casting resin powder formulation.

This method prevents that the alloy particles will be exposed to a mechanical load during the manufacturing process, contrary to the injection molding process, which had been discussed on the basis of DE 198 49 781 A at the beginning. Furthermore, the insulation coating, which was applied to the coil wires, will not be damaged particularly when using a mold, which was equipped with a prefabricated coil, since filling the casting resin formulation or the casting resin powder formulation, of which the viscosity is preferably as low as possible, in the mold does not damage them due to the soft discharge of the formulation. Casting resin formulations having viscosities of a few mill Pascal seconds are preferred in particular.

In an additional embodiment of the present invention it has been particularly advantageous, particularly with respect to achieving a considerable filling level in the mold, to mix the alloy powder with the casting resin formulation before filling the mold. A small amount of excess casting resin formulation can be used in this embodiment of the present invention, which benefits the fluidity of the casting resin powder formulation then created. The mold will be made to vibrate by means of a suitable device, for instance by means of a compressed air vibrator, which will thoroughly mix the casting resin formulation and thus fluidize it. The casting resin formulation will be degassed at the same time.

The allow powder deposits itself in the mold without any difficulties, since the alloy powder features a rather high density as compared with the casting resin, so that the used casting resin excess can be collected in a feeder for instance, which can be removed once the powder composite has hardened.

Inductive components can be produced in one pass due to the use of molds, which are already equipped with prefabricated coils, without a subsequent labor-intensive "wrapping" or application of prefabricated coils onto partial cores, and without a subsequent assembly of the partial cores to complete cores being required.

The mold, which is filled with the alloy powder and the casting resin formulation, or which was filled with a prefabricated casting resin formulation, will continue to be used as the casing of the inductive composite in a preferred embodiment of the invention. This means that the mold serves as a "lost casing" in this embodiment of the present invention. This approach provides for a particularly effective and cost-efficient method, which brings with it significant simplifications particularly in contrast to the injection molding process, which had been discussed at the beginning. A mold will always be required for the injection molding process, the production of which is very expensive and costly in addition thereto, and which can never serve as "lost casting".

In the injection molding process the manufactured component or the manufactured soft magnetic core made from a powder composite will always have to be removed from the mold, which is very costly and which leads to extended production times.

Polymer components, which were mixed with a polymerization initiator (starter), are typically used as casting resin formulations. Methacrylic acid methacrylic esters are considered as polymer components in particular. However, other polymer components, for instance lactame, can be used as well. The methacrylic acid methacrylic esters are polymerized into polyacrylics after having been cured. In an analogous manner, lactame will be polymerized into polyamides via a poly addition reaction.

Dibenzoyl peroxide are considered as polymerization initiators as well as 2,2'-azo isobutanoic acid dinitril for instance.

However, other polymerization processes of the known casting resins are also possible, such as for instance polymerizations, which are triggered via light or UV radiation that in other words largely manage without polymerization initiators.

The alloy particles are aligned during and/or after the filling of the mold with the alloy powder by means of the creation of a magnetic field in a particularly preferred embodiment of the invention. This can take place particularly when using molds, which have already been equipped with a coil, by means of directing a current through the coil and the accompanying magnetic field. The alloy particles are aligned by means of the creation of magnetic fields, which effectively show field strengths exceeding 10 A/cm.

It is particularly advantageous to align the alloy particles, which are forman-isotropic, along the magnetic field lines, which exist in the subsequently operated inductive component. A significant reduction of the losses and an increase of the permeability of the soft magnetic cores and thus the inductivity of the inductive component can be achieved by aligning the alloy particles by means of their "long" axis parallel to the magnetic field lines.

To obtain higher permeabilities of the soft magnetic core, it is advantageous, when using casting resin powder formulations, to create a magnetic field already at the point of filling the casting resin powder formulation together with the coil, which is lying in the mold, which will act in the direction of the magnetic current thus directing the alloy particles. The mold will be vibrated after having been completely filled, which for instance may take place by means of the aforementioned compressed air vibrator, and the magnetizing stream will be turned off subsequently. The resulting inductive component will be removed from the form after the final curing of the casting resin formulation.

Figure 2:
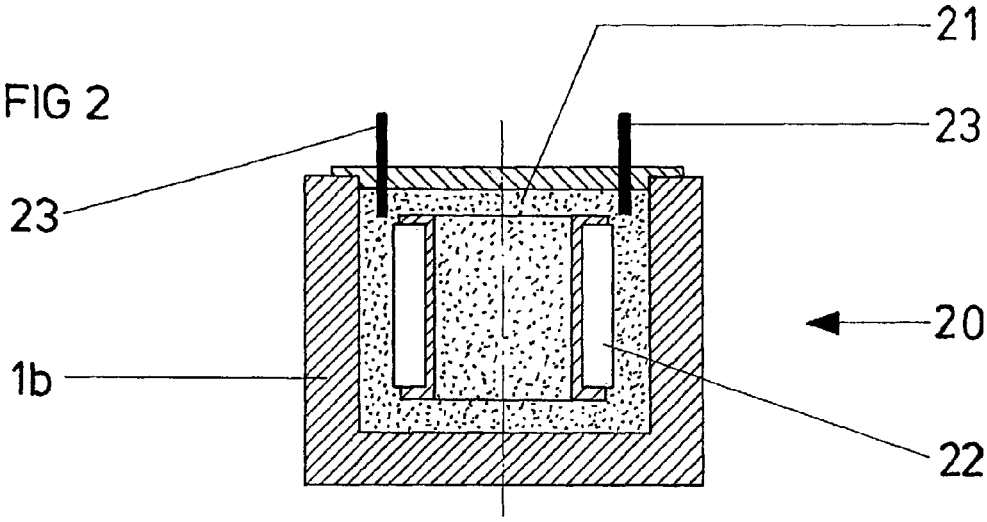

The invention shall be explained by means of three embodiment samples and the attached illustration. The following shall be shown:

FIG. 1: A cross-section of an inductive component in accordance with an initial embodiment of the present invention;

FIG. 2: A cross-section of an inductive component in accordance with a second embodiment of the invention; and FIG. 3: A cross-section in accordance with a third embodiment of the present invention.

FIG. 1 shows inductive component 10. Inductive component 10 consists of soft magnetic core 11 and coil 12, consisting of relatively thick copper wire including a few coils. FIG. 1 shows component 10 during its production. Component 10 is brought into mold 1*a*, which in this case consists of aluminum.

FIG. 2 also shows inductive component 20, consisting of a soft magnetic core made from powder composite 21 in which layer coil—bobbin coil former 22 was brought in. Layer coil—bobbin coil former 22 is connected to pins 23 at its coil ends, which protrude from soft magnetic core 21, and serve to connect to a base plate, for instance a conductor board. Inductive component 20 in FIG. 2 is shown as well as in FIG. 1 during its production. This means that inductive component 20 is shown here in mold 1*b*, into which the powder composite is poured.

Figure 3:
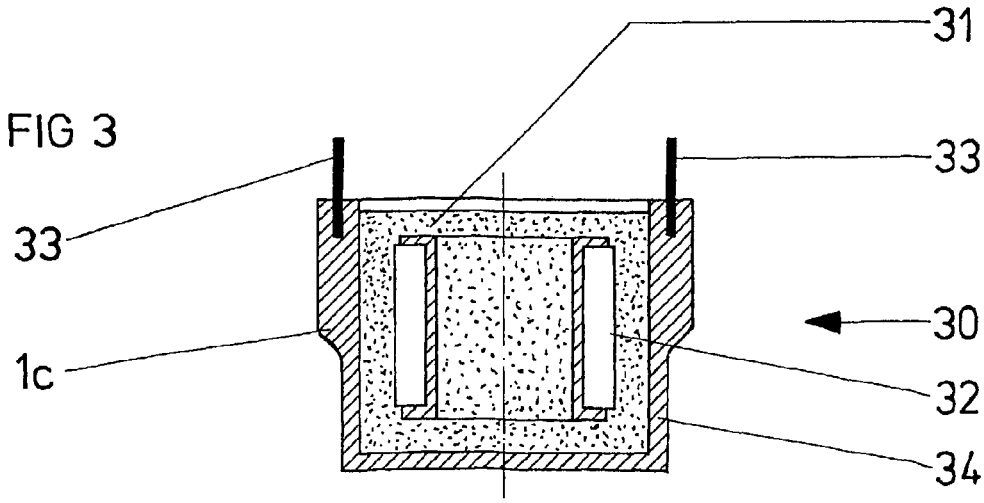

FIG. 3 also shows an inductive component as in FIGS. 1 and 2. Inductive component 30 shown here consists of soft magnetic core 31 made from a powder composite into which in turn layer coil—bobbin coil former 32 was brought in. Layer coil—bobbin coil former 32 is connected at its coil ends with connection pins 33, which protrude from mold 1*c*, which also serves as casing 34.

The following embodiments of the invention are identical in all three embodiments shown in FIGS. 1 through 3, as long as not explicitly specified otherwise.

The base material for the powder composite in all three embodiments of the invention consists of an alloy, which is composed as follows: $Fe_{73.5}Cu_1Nb_3Si_{15.5}B_7$, which have been produced in accordance with the known quick set technology process as thin metal strips. It is noted again that these manufacturing processes are explained in detail for instance in EP 0 241 657 A2. These alloy strips are subsequently heat treated for purposes of setting the nano-crystalline structure under hydrogen or in a vacuum at a temperature of approx. 556° C. The alloy strips are crushed in a grinder to achieve the desired final fineness after this crystallization treatment. The thickness of the alloy particles, which typically resulted from this process ranged from 0.01 to 0.04 mm, and the measurements of the two other dimensions ranged from 0.04 to 1.0 mm.

The alloy particles, which were created in this manner, and which are occasionally called flakes, are now provided with a surface coating in order to improve their dynamic magnetic characteristics. First of all a specific surface oxidation of the alloy particles by means of a heat treatment at temperatures ranging from 400° C. to 540° C. for a duration ranging from 0.1 to 5 hours were performed for this purpose. The alloy particles' surface was covered with an abrasion-proof layer consisting of iron and silico-oxide with a typical layer thickness of approx. 150 to 400 nm after the heat treatment.

The alloy particles were coated with silane in a fluidized bed coater following the surface oxidation. The layer was subsequently annealed at temperatures ranging from 80° C. to 200° C. for 0.1 to 3 hours.

The alloy particles, which were prepared in this manner, were subsequently filled in molds 1*a* or 1*b* in the embodiments of the invention, which are illustrated in FIGS. 1 and 2. Molds 1*a* or 1*b*, which are made of aluminum, featured a suitable isolation coating at their interior walls so that the removal of inductive components 10 or 20 from the mold was uncomplicated. Electric currents were conducted through coils 12 or 22 so that the alloy particles aligned themselves with their "long axis" parallel to the thus created magnetic field, which was approx. 12 A/cm.

Subsequently, a casting resin formulation was filled in the respective molds, which were filled with alloy powder in the embodiment examples of invention, which are illustrated in FIGS. 1 and 2.

A thermoplastic methacrylate formulation was filled together with a silane bonding agent into the embodiment of the invention, which is shown in FIG. 1. This thermoplastic methacrylate formulation was composed of the follows:

| | |
|---|---|
| 100 g | methacrylic acid methacrylic esters |
| 2 g | methacrylic trimethoxy silane |
| 6 g | dibenzoyl peroxide and |
| 4.5 g | N,N-dimethyl-p-toluidine |

Likewise, a thermoplastic methacrylates formulation together with a silane bonding agent was filled in the embodiment of the invention illustrated in FIG. 2, whereby this methacrylate formulation was composed as follows:

| | |
|---|---|
| 100 g | methacrylic acid methacrylic esters |
| 2 g | methacrylic trimethoxy silane |
| 10 g | diglycoldimethacrylate |
| 6 g | dibenzoyl peroxide and |
| 4.5 g | N,N-dimethyl-p-toluidine |

The above-mentioned chemical components were dissolved one after the other in methacrylic ester in both embodiments of the invention. The final mixture was clear like water in both cases. It was subsequently poured into molds 1*a* and 1*b*. The casting resin formulations were cured in both cases at room temperatures within approx. 60 minutes. Post-curing at approx. 150° C. took place after that for an additional hour.

When filling molds 1*a* or 1*b* with the alloy powder it proved to be practical to vibrate molds 1*a* or 1*b* during the filling process, in order to thus densify the alloy powder. In both cases volume shares of up to 55 vol % of the alloy powder could be easily obtained in the powder composite by means of this process.

A hot curing thermoplastic methacrylate formulation was used in the embodiment of the invention, which is shown in FIG. 3, and which is composed of the following:

100 g methacrylic acid methacrylic esters 0.1 g 2,2'-azo isobutanoic acid dinitril.

This casting resin formulation was filled into mold 1*c*, as shown in FIG. 3, and cured within 15 hours at a temperature of approx. 50° C. Since mold 1*c* in FIG. 3 was used as "lost casing", i.e., since it was used as casing 34 for the inductive component after the production process, the use of a hot curing casting resin formulation had proven to be particularly beneficial as it succeeded in creating a particularly intense and superior contact between mold 1*c*, which is made of plastic, and the powder composite.

This casting iron formulation was then post cured at a temperature of approx. 150° C. for one hour.

It is noted that the afore-mentioned casting resin formulations only serve as examples. A large variety of other casting resins can be used, of which the chemical cross-links differ from the above-mentioned formulations.

For the sake of completeness it is noted that the above-mentioned formulations were polymerized and that dibenzoyl peroxide or 2,2'-azo isobutanoic acid dinitril was used as starter substances. However, it is specifically possible to make do without a special starter substance, and to polymerize monomer components, i.e. chemical substances such as the methacrylic acid methacrylic ester mentioned here, by means of ultraviolet light.

The toughness or the impact resistance of the created powder composite can be increased in particular when mixing in methacrylic trimethoxy silane or diglycoldimethacrylate and other chemical substances.

In particular, melts created from ϵ-caprolactam and phenylisocyanate can be used when using thermoplastic polyamides; thus a melt created from 100 g ϵ-caprolactam and 0.4 g phenylisocyanate, which were mixed at a temperature of 130° C., has proven suitable in subsequent tests. This melt was then filled into a form, which had been preheated to 130° C. The curing of caprolactam to a polyamide occurred within approx. 20 minutes. Post-curing at higher temperatures was generally not required when using this process.

Naturally, another lactam can be used instead of caprolactam, such as for instance laurinlactam, together with an appropriate bonding phase. However, process temperatures exceeding 170° C. will be required for processing laurinlactam.

Inductive components having soft magnetic cores were made from ferro-magnetic powder composites using the above-mentioned casting resin formulations, which showed much lower remagnetizing losses than the inductive components, which were produced in an analog manner using the injection mold process. Thus for instance remagnetizing losses ranging from 200 to 600 w/kg were reached using injection molded components at 100 kHz and a shakedown of 0.1 tesla.

Whereas losses under 100 w/kg could be reached using the inductive component and the accompanying manufacturing process under the same magnetizing conditions, whereby the filling degrees of the injection molded inductive components and of the inductive component, which has been produced by means of the process in accordance with this invention, were almost identical.

The invention claimed is:

1. Inductive component having at least one coil and a magnetic soft core made from a ferromagnetic powder composite; said ferromagnetic powder composite comprising an alloy powder from a nano-crystalline alloy and a casting resin and said at least one coil being embedded in said ferromagnetic powder composite, wherein the alloy powder is not exposed to a mechanical load during processing.

2. Inductive component in accordance with claim 1, wherein the alloy powder consists of alloy particles of an average particle size of <2 mm.

3. Inductive component in accordance with claim 2, wherein the average thickness of the alloy particles ranges between 0.04 mm and 0.5 mm.

4. Inductive component in accordance with claim 2, wherein the alloy particles are surface oxidized.

5. Inductive component in accordance with claim 2, wherein the alloy particles are coated with a plastic.

6. Inductive component in accordance with claim 5, wherein the plastic is silane.

7. Inductive component in accordance with claim 1, wherein the powder composite shows a saturation magnetization of $B_S \geqq 0.5$ tesla, and a permeability of $10 \leqq \mu \leqq 200$.

8. Inductive component in accordance with claim 1, wherein a polyamide or a polyacrylate is provided as casting resin.

9. Inductive component in accordance with claim 1, further comprising a casing.

10. Inductive component in accordance with claim 1, whereby the alloy powder's portion in the powder composite exceeds 55 percent by volume.

* * * * *